US012611027B1

(12) United States Patent
Durbin

(10) Patent No.: US 12,611,027 B1
(45) Date of Patent: Apr. 28, 2026

(54) BEAR SPRAY CANISTER CARRYING AND DEPLOYMENT DEVICE

(71) Applicant: David M Durbin, Temecula, CA (US)

(72) Inventor: David M Durbin, Temecula, CA (US)

( * ) Notice: Subject to any disclaimer, the term of this patent is extended or adjusted under 35 U.S.C. 154(b) by 0 days.

(21) Appl. No.: 19/253,266

(22) Filed: Jun. 27, 2025

Related U.S. Application Data

(60) Provisional application No. 63/762,032, filed on Feb. 23, 2025.

(51) Int. Cl.
*A45F 5/00* (2006.01)
*F41H 9/10* (2006.01)

(52) U.S. Cl.
CPC ..... *A45F 5/00* (2013.01); *F41H 9/10* (2013.01); *A45F 2005/008* (2013.01)

(58) Field of Classification Search
CPC ..... F41H 9/10; A45F 5/00; A45F 2005/008; A45F 5/1566; A45F 5/1516; A45F 2003/006
USPC ..... 224/148.5, 901.4, 148.7, 218, 222, 674, 224/219; 222/175; 2/160
See application file for complete search history.

(56) References Cited

U.S. PATENT DOCUMENTS 4,504,980 A * 3/1985 Butcher ..... A41D 19/01552 2/160
5,009,347 A * 4/1991 Phelps ..... A45F 5/00 224/267
5,484,085 A 1/1996 Bennett
5,607,090 A * 3/1997 Brown ..... A45C 1/04 224/217
5,678,730 A * 10/1997 Fabek ..... A45F 5/00 222/402.15
5,961,003 A * 10/1999 Coryell ..... F41H 9/10 222/175
8,154,844 B2 4/2012 Brown
(Continued)

OTHER PUBLICATIONS

Rei, "Counter Assault Backpacker / Cross Draw Neoprene Bear Spray Holster Video", youtube: https://www.youtube.com/watch?v=sjfrwRkmlks , Feb. 10, 2023. (Year: 2023).*
(Continued)

*Primary Examiner* — Corey N Skurdal
(74) *Attorney, Agent, or Firm* — Peter A. Borsari

(57) ABSTRACT

A bear spray canister carrying and deployment device for retaining a bear spray canister which integrates ergonomic positioning, single-hand operation and an optimized deployment angle which can facilitate a rapid response by a user without removing a bear spray canister from the carrying and deployment device. The carrying and deployment device can be in the form of an ergonomic armband sleeve or a compression sleeve to be worn on a user's forearm. When a bear spray canister is secured within a retaining pouch affixed to the carrying device, ergonomically spaced and positioned relative to the user's hand, wrist, and forearm. This positioning allows for the natural and efficient deployment with minimal hand movement and with the use of only one hand. Moreover, the spacing and positioning enhances accessibility and ease of activation, ensuring quick response time in self-defense situations without removal of the canister from the carrying device.

29 Claims, 6 Drawing Sheets

(56) References Cited

U.S. PATENT DOCUMENTS

| | | | | |
|---|---|---|---|---|
| 8,752,740 | B2 * | 6/2014 | Morgan | A45F 5/00 224/222 |
| 9,927,213 | B2 | 3/2018 | Komperda | |
| 9,989,335 | B2 | 6/2018 | Purvis | |
| 2012/0152989 | A1 * | 6/2012 | Draper | A45C 1/04 224/191 |

OTHER PUBLICATIONS https://www.finandfire.com/products/stone-glacier-skyline-bear-spray-holster.
https://www.sabrered.com/bear-accessories/sabre-frontiersman-bear-spray-belt-waterproof-bear-deterrent-waist-holster-with-secure-pouch-zippered-pocket/.

* cited by examiner

BEAR SPRAY CANISTER CARRYING AND DEPLOYMENT DEVICE

CROSS-REFERENCE TO RELATED APPLICATIONS

This application claims priority from U.S. Provisional Application 63/762,032, filed Feb. 23, 2025.

FIELD OF THE INVENTION

The present invention relates to a device for carrying a deterrent spray canister, particularly a bear spray canister. More particularly, the present invention relates to an ergonomically designed armband sleeve to be worn naturally on user's arm, particularly a user's forearm, the armband sleeve configured to retain a canister of deterrent spray, and to provide the user with quick and easy activation in a rapid grip-and-spray motion without requiring the user to remove the canister from the device.

BACKGROUND OF THE INVENTION

The traditional method of carrying a deterrent spray, particularly a bear spray, typically involves the use of cumbersome containers strapped to belts or backpack shoulder straps, worn across the chest, or stowed in heavy backpacks. While these methods are functional, they are not ideal. First, these types of holsters for carrying a spray canister are awkward, digging into the user's side, bumping against the user's chest, and are big and weighty. More significantly, these traditional methods of carrying a bear spray canister require that the user remove the spray canister from the holster or other carrying device prior to deployment and as result do not enable the user with immediate access to the actuator for activation.

PRIOR ART

The prior art is replete with devices for carrying a deterrent spray on a wrist or arm. For example, U.S. Pat. No. 5,484,085 to Bennett discloses a wrist-carriable protective sprayer having a carrier pouch coupled to a user's forearm with a canister of protective spray disposed within the pouch, an elongated guide rail and bracket which extended to a finger-holding mechanism with an actuatable spray nozzle coupled to the guide rail. In operation, a user's thumb manipulates the device stowed on the wrist toward the user's fingers for actuating the spray nozzle. A significant drawback to the Bennett device is its obvious complexity, particularly the requirement of precise manipulation of the user's thumb and fingers, which adds time and precision to the deployment process which may delay an immediate response. Another drawback is the specialized finger-holding mechanism that requires the user to position a finger into a specific slot to extend the actuating spray nozzle, again necessitating additional time and hand to finger coordination to activate the deterrent spray.

U.S. Pat. No. 8,154,844 B2 to Brown describes a personal defense device having a shield member configured to be worn over at least a third of the length of a user's forearm and includes an electrical shock bar configured to receive an electric current and deliver an electric shock to a human or other animal. In addition to not carrying a deterrent spray, another drawback to the Brown device is that the shield member must be manually operated and positioned for an electrical shock delivery which is much less efficient and certainly must less effective when a sudden, high-pressure situation with a wild animal like a bear or mountain lion is encountered.

U.S. Pat. No. 9,927,213 B2 to Komperda provides a self-defense fingerless glove having a deterrent spray canister contained within a pocket disposed inside the rear portion of the glove and another complex deployment mechanism requiring the user to activate a control on the palm to trigger the spray canister inside the glove. The need for a user to manually activate the control and aim the canister is problematic as it can lessen the ability of quick deployment as it requires a series of finger movements which is less effective in an intense, high-stakes encounter with a human or wild animal.

U.S. Pat. No. 9,989,335 B2 to Purvis teaches the use of a lightweight forearm gauntlet sleeve which extends over the user's hand, the hand portion having a pistol grip with an electronic control system for selectively activating one of a multiplicity of external mounts for holding different types of ammunition, likely pepper spray, rubber bullets, and the like. Again, the Purvis device provides an exceedingly complex arrangement intended for the user to choose a specific non-lethal ammunition and shortened vented composite less-lethal ammunition barrels of various calibers. This arrangement not only is cumbersome but is time-consuming, resulting in delayed reaction time when the user is in imminent danger upon encountering a wild animal requiring an immediate deterrent response.

Commercially available deterrent spray canister holders which are contained within a pouch mounted to a backpack device or on belt holsters are inefficient and ineffective when an immediate response to a dangerous situation is encountered because of the time delay in removing the canister from the pouch, such as by unclipping, unzipping, or other means of retrieving the canister before use and prior to aiming the device, and actuating the trigger to spray the deterrent chemical. While these holsters and holders provide a means of transport, they do not address the critical issue of immediate accessibility in high-stress, time-sensitive situations where literally seconds can determine the difference between safety of user and injury to the user.

Despite the efforts provided in the prior art, a need still exists for a bear spray canister carrying and deployment device which integrates ergonomic positioning, single-hand operation and an optimized deployment angle which can facilitate a rapid response. Such a carrying and deployment device also should provide the user with immediate accessibility to the bear spray without requiring the removal of the canister from the carrying device, particularly in high-pressure and dangerous encounters.

SUMMARY OF THE INVENTION

The present subject matter is directed to a bear spray canister carrying and deployment device which is ergonomically designed to be worn comfortably on the forearm of a user and provides the user with immediate access to the actuator which is disposed literally at the user's fingertips, without removal of the spray canister from the carrying and deployment device.

Accordingly, it is an object of the present invention to provide a bear spray canister carrying and deployment device which remains firmly attached to the forearm of a user and comprises a pouch for retaining a bear spray canister and holding the canister tightly in place, and which does not require removal of the canister to use the actuator and deploy the deterrent spray.

It is another object of the present subject matter to provide a bear spray canister carrying and deployment device which is ergonomically designed to be worn comfortably on the forearm of the user while the user is engaged in physical activity, such as running, biking, or hiking.

It is yet another object of the present subject matter to provide a bear spray canister carrying and deployment device comprising a pouch for retaining a bear spray canister which is designed such that the canister does not shift or fall out, particularly during dynamic activities like trail running, hiking and mountain biking.

It is still another object of the present subject matter to provide a bear spray canister carrying and deployment device which provides for quick and easy, one-handed access to the bear spray canister's actuator literally at the user's fingertips.

It is a further object of the present subject matter to provide a bear spray canister carrying and deployment device which can be disposed under the user's arm for rapid access, rotated to the side of the user's arm during every day movement, and quickly rotated back to the underside of the user's arm for quick deployment.

It is yet a further object of the present subject matter to provide a bear spray canister carrying and deployment device which enables the user to defend against fast, ambush-style attacks from wild animals, such as mountain lions and rapidly charging bears with no warning, when reaction speed is critical.

It is still a further object of the present subject matter to provide a bear spray canister carrying and deployment device which provides ergonomic alignment of the device to place the actuator near the user's index and middle fingers, thereby enabling the user with an intuitive, reflexive, and immediate response.

It is another object of the present subject matter to provide a bear spray canister carrying and deployment device which is ergonomically designed such that in the event of an attack, the raising of the user's arm, which is an instinctive reaction, automatically brings the deterrent spray into an optimal position for deployment.

It is an additional object of the present subject matter to provide a bear spray canister carrying and deployment device that is lightweight, secure, suitable for daily wear, and configured for use by hikers, trail runners, mountain bikers, backcountry skiers, hunters, fisherman, wildlife professionals and rural residents.

It is yet a further object of the present subject matter to provide a bear spray canister carrying and deployment device that is designed to accommodate standard bear spray canisters while maintaining a slim and ergonomic profile that minimizes interference with user movement and enables rapid deployment during emergency situations.

It is yet another object of the present subject matter to provide a bear spray canister carrying and deployment device which is in the form of an armband sleeve.

It is still another object of the present subject matter to provide a bear spray canister carrying and deployment device which is in the form of a compression sleeve.

It is an additional object of the present subject matter to provide a bear spray canister carrying and deployment device having an adjustable armband sleeve or a compression sleeve which is customized in various sizes to accommodate a range of forearm sizes.

It is a further object of the present subject matter to provide a bear spray canister carrying and deployment device, in the form of an armband sleeve composed of a synthetic elastomer, elastomeric blends, nylon, nylon blends, ripstop nylon, ballistic nylon, polyester, polyester blends, leather, synthetic leather (pleather), Lycra™, spandex, polyethylene blends, neoprene, elastomeric mesh fabrics, or any other suitable materials having flexible and/or elastic properties.

It is an additional object of the present subject matter to provide a bear spray canister carrying and deployment device which further comprises a securing mechanism or element which secures the bear spray canister within the retaining pouch disposed on the carrying and deployment device, and which provides the user with adjustability, adaptability, and customization.

DESCRIPTION OF THE INVENTION

Figure 1:
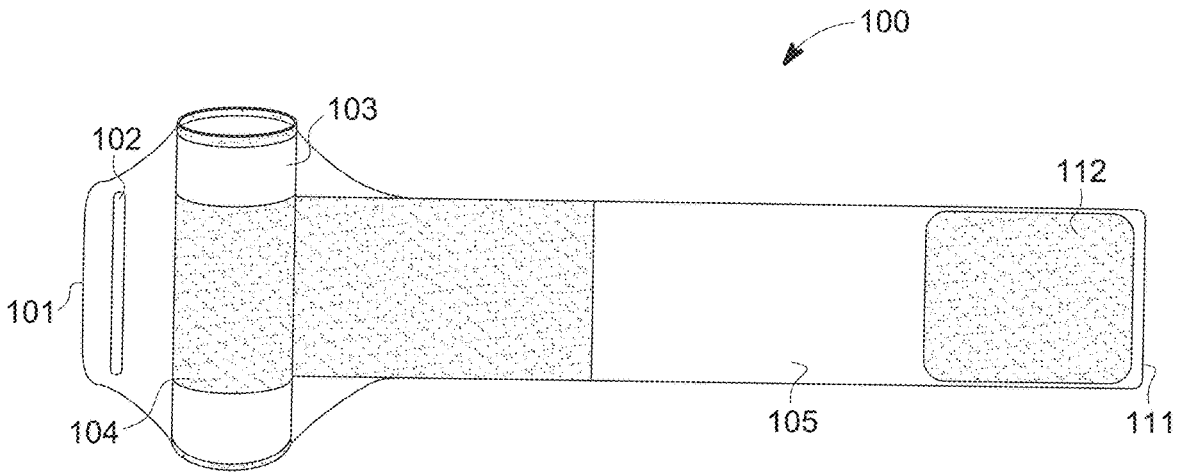
FIG. 1 is a top perspective view of the bear spray canister carrying and deployment device of the present subject matter.

In the following description, like reference numbers are used to identify like elements. Furthermore, the drawings are intended to illustrate major features of exemplary embodiments in a diagrammatic manner. The drawings are not intended to depict every feature of every implementation nor relative dimensions of the depicted elements and are not drawn to scale.

In the following description, numerous specific details are set forth to clearly describe various specific embodiments disclosed herein. One skilled in the art, however, will understand that the presently claimed invention may be practiced without all the specific details discussed below. In other instances, well known features have not been described so as not to obscure the invention.

Also, it is to be understood that the phraseology and terminology used herein is for the purpose of description and should not be regarded as limiting. The use of the terms "including", "comprising", "having", and variations thereof herein is meant to encompass the items listed thereafter and equivalents thereof as well as additional items.

Further, it is to be understood that the terms "sleeve", "arm sleeve", "armband", "forearm sleeve", "carrier sleeve", "carrying sleeve", "compression sleeve" derivatives and variations thereof as used throughout the specification are interchangeable and all refer to the bear spray canister carrying and deployment device of the present subject matter.

The present subject matter is directed to a bear spray canister carrying and deployment device comprising a retaining pouch for securing a bear spray canister therein. Bear spray is designed to deter wild animals, particularly large wild animals including charging bears and mountain lions. With a high concentrate of the active ingredient oleoresin capsicum (OC), typically 2.0%, bear spray can be used at a longer range (up to 40 feet) with a more forceful spray pattern, creating a fog-like spray ideally suited to deter large animals encountered in the wild. Studies have shown that bear spray is over 90% effective at preventing an encounter from becoming an attack when deployed quickly and properly. The typical size range of a bear spray canister ranges from 7.9 ounces (the smaller size) to 10.2 ounces (the larger size). The larger size canister provides the user with increased spray duration and distance. Regardless of size, typical bear spray canisters generally are cylindrical in shape and designed to be easily carried. The dimensions of a conventional bear spray canister are between from about 8.5" to about 9.5" tall, between from about 2.7" wide to about 2.75" wide at the handle, and between from about 2.0" to about 3.0" in canister diameter. Accordingly, the retaining pouch for use with the bear spray canister carrying and deployment device, must be designed to securely hold any bear spray canister regardless of size.

The term bear spray as used throughout the specification and claims is meant to include any type of spray which is housed in a canister-like dispenser and is used as a deterrent spray for large animals, such as bears, mountain lions, elk, wild boar, moose, and similar large wild predators which can be encountered, particularly while hiking, running, or mountain biking on any outdoor trail. Such deterrent sprays against large predators collectively are referred to as bear spray. Thus, the bear spray canister carrying and deployment device of the present subject matter can be used in nearly any wildlife environment for personal self-defense.

In a first embodiment of the present subject matter, the bear spray canister carrying and deployment device comprises a webbing strap having a proximal end, a retaining pouch affixed near the proximal end, and a distal end. The proximal end and distal end are detachably fastened to one another to form an ergonomically designed armband sleeve that is comfortably fitting and conforming to a user's arm, particularly a user's forearm. A bear spray canister is disposed and secured within the retaining pouch that is ergonomically spaced and positioned relative to the user's hand, wrist, and forearm. This positioning allows for the natural and efficient deployment of the bear spray with minimal hand movement. Moreover, the positioning enhances accessibility and ease of activation, ensuring quick response time in self-defense situations. The precise angle may be varied provided it remains within a range that facilitates an intuitive and rapid grip-and-spray motion without requiring wrist strain or unnatural positioning of the user's hand. When the armband sleeve is worn on the user's forearm, the ergonomic alignment positions the actuator of the bear spray canister near the user's index and middle fingers, enabling rapid deployment with minimal hand movement.

Figure 2:
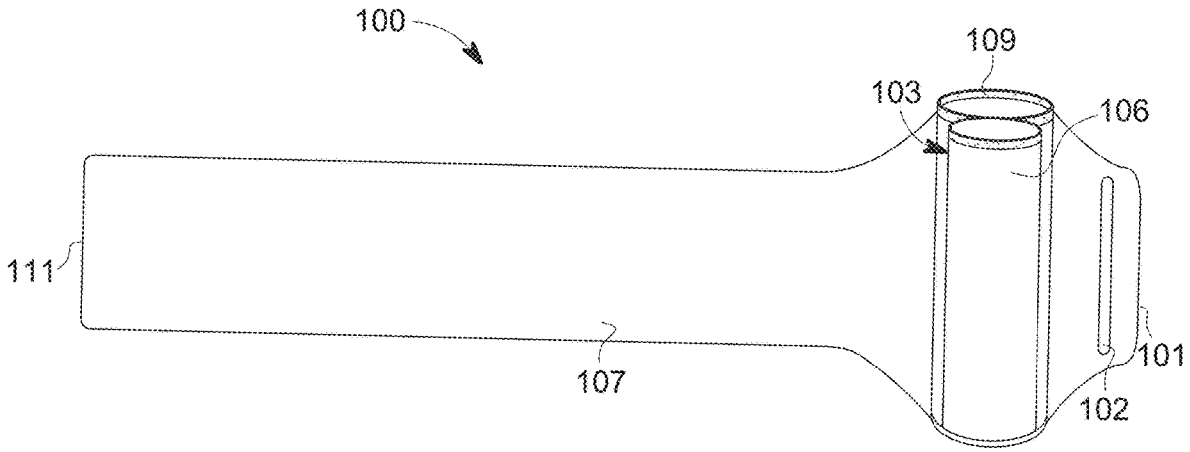
FIG. 2 is a rear perspective view of the bear spray canister carrying and deployment device of the present subject matter.

Referring now to FIG. 1 and FIG. 2, a bear spray canister carrying and deployment device is in the form of an armband sleeve 100 comprising a webbing strap having a proximal end 101, a retaining pouch 103 affixed near the proximal end, a front surface 105, a rear surface 107, and a distal end 111. In one embodiment, the proximal end 101 is provided with a slotted opening 102. The retaining pouch 103 is designed to securely hold and retain a canister of bear spray, ensuring that it is held in place during movement while allowing ease of access when necessary. The pouch 103 may be composed of a range of durable, resistant materials having flexible and/or elastic properties, such that the material conforms snugly around the spray canister retained therein. Suitable materials for the retaining pouch include, but are not limited to, synthetic elastomers, elastomeric blends, nylon, nylon blends, ripstop nylon, ballistic nylon, leather, synthetic leather (pleather), Lycra™, spandex, polyethylene blends, neoprene, and elastomeric mesh fabrics. In a preferred embodiment, the retaining pouch is composed of neoprene or a neoprene blend. The selected material for the pouch must ensure a certain level of stability that the bear spray canister will remain firmly secured and retained within the pouch of the carrying and deployment device even during dynamic activities such as hiking, trail running, mountain biking, backcountry skiing, hunting, and fishing, as the armband sleeve is designed to move with the user.

The interior lining of the retaining pouch 103 may be provided with elasticized edges, as well as rubberized or silicone elements that can grip the canister and provide additional friction to prevent movement of the deterrent spray canister disposed within the pouch, while offering quick, reliable access when necessary. In one embodiment, the interior lining of the retaining pouch comprises a rubber lining to grip the spray canister and prevent movement or rotation. The retaining pouch 103 can be affixed to the proximal end 101 of the armband sleeve by any means obvious to those skilled in the art, including adhesives. Preferably, the retaining pouch 103 is sewn into the proximal end 101 by stitching. The upper rim 109 of the pouch can be provided with a conventional edge binding. In one embodiment, the retaining pouch can be in the form of a zippered pouch snugly and firmly holding the bear spray canister. In an alternate embodiment, the retaining pouch may be removably affixed to the webbing strap.

Figure 3:
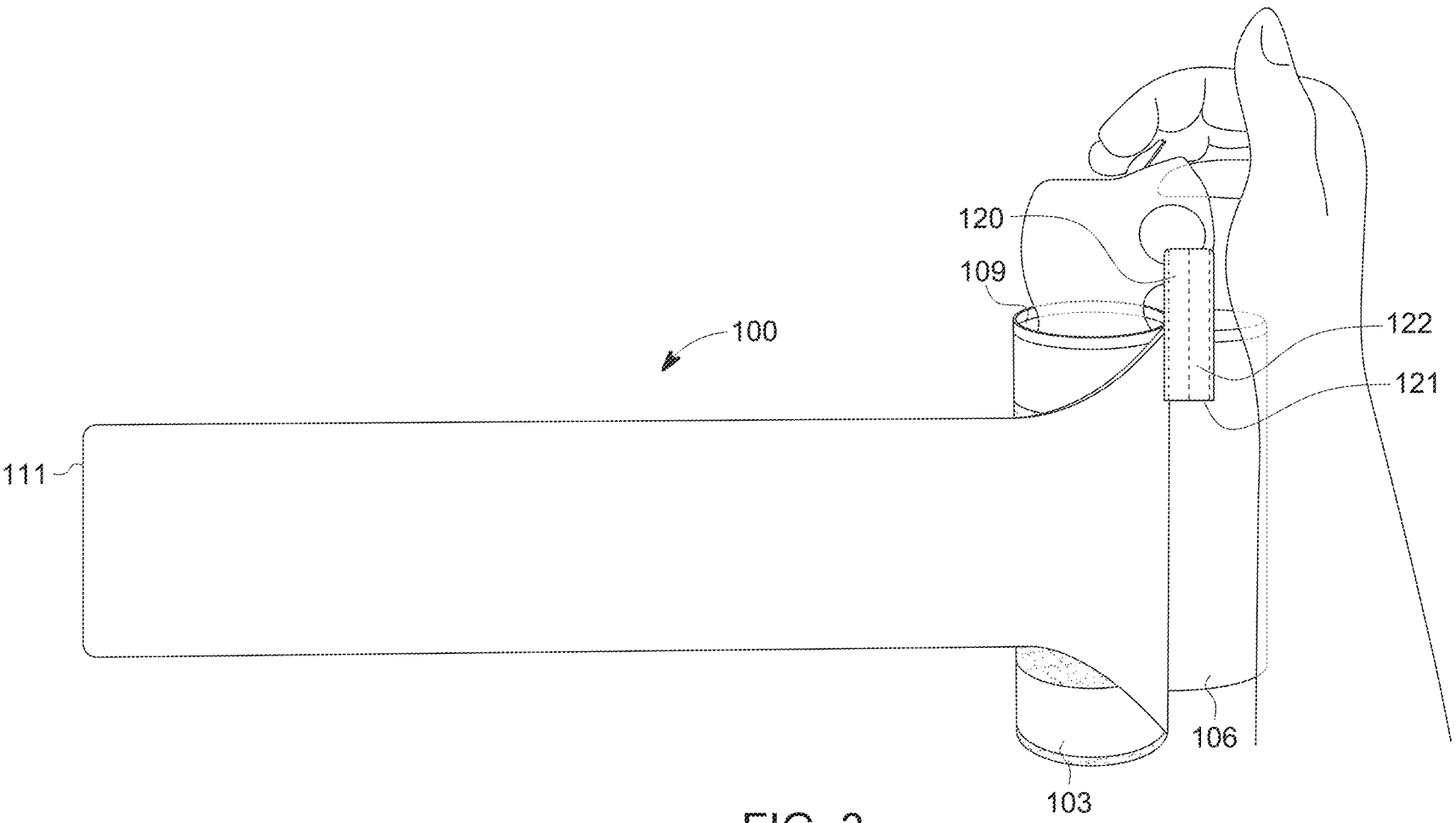
FIG. 3 is a rear side perspective view of the bear spray canister carrying and deployment device of the present subject matter with the bear spray canister secured within a retaining pouch.

Referring now to FIG. 3, the bear spray canister carrying and deployment device of the present subject matter may further comprise a lightweight foam padding 106. This foam padding is an impact-dampening layer in the form of a shaped segment that creates an ergonomic interface by providing a controlled separation between the retaining pouch 103 and the forearm of a user. With this arrangement, the foam padding enables optimal placement of the bear spray canister against the user's forearm and ensures that the retaining pouch 103 contours naturally to the user's forearm for enhanced comfort, accessibility, and rapid deployment of the deterrent spray when necessary. Suitable materials for use as the lightweight foam padding include, but are not limited to ethylene vinyl acetate (EVA) foam, expanded polyethylene (EPE) foam and polyurethane (PU) foam. In one embodiment, the lightweight foam padding is about one inch (1") in thickness.

The foam padding 106 may be affixed to the rear surface 107 of the retaining pouch 103 by any means obvious to those skilled in the art including, for example, stitching, adhesives, or a combination of both. In one embodiment, the foam padding is laminated to the rear surface 107 of retaining pouch 103 with an industrial-grade adhesive, ensuring a continuous planar contact between the retaining pouch 103 and padding 106. Preferably, the lightweight foam padding 106 is encapsulated by an outer cover layer which is composed of the same material as the retaining pouch, wrapped over the foam padding, and securely attached to the pouch using reinforced seam binding. The seam binding encases the edges of the cover layer and the pouch itself. Along the seam binding, stitching is applied continuously around the perimeter to mechanically lock the covered foam padding in position, ensuring structural integrity and durability during prolonged and repeated used.

In a preferred embodiment, the top of the retaining pouch incorporates a securing mechanism which is configured to securely retain the bear spray canister within the pouch while allowing for swift activation when necessary. The securing mechanism is a key component of the design, ensuring that the spray canister is held firmly and snugly within the pouch, thereby preventing accidental drops, canister movement during activity, or misalignment, while also providing immediate functionality during critical situations.

Figure 4:
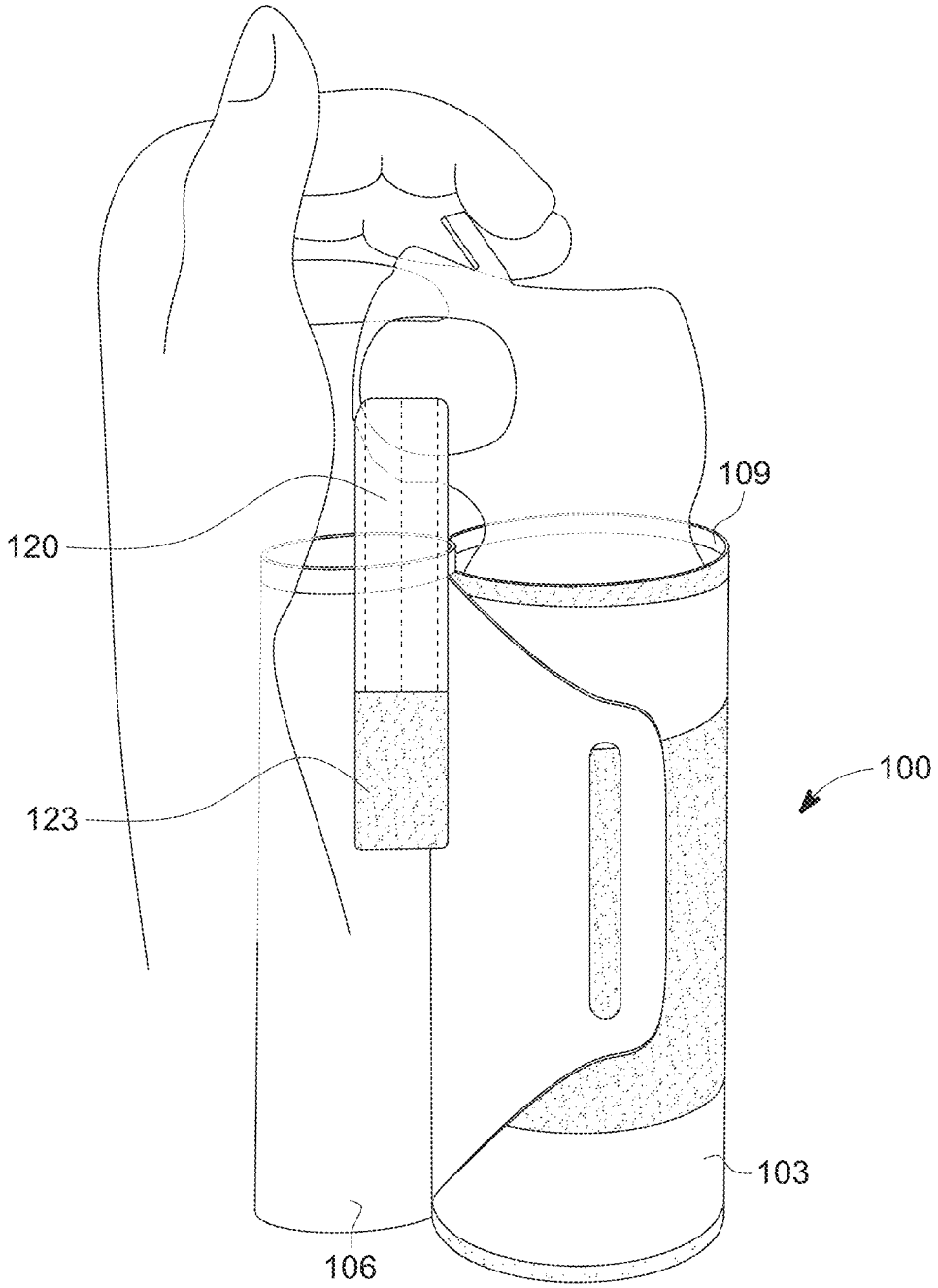
FIG. 4 is a side perspective view of the bear spray canister carrying and deployment device of the present subject matter illustrating the process of being strapped onto the forearm of a user with a bear spray canister secured within the retaining pouch and the safety clip and actuator positioned at the user's fingertips.

FIG. 3 and FIG. 4 illustrate a bear spray canister securely held within the retaining pouch 103 of the present subject matter utilizing a securing mechanism. The canister is disposed within the retaining pouch 103 and ergonomically positioned at the precise angle to ensure that the user's fingers are in easy placement on the safety clip and actuator. This ergonomic angle between the hand, wrist, forearm, and the pouch, ensures optimal positioning and stability during use. In one embodiment, the canister securing mechanism is a canister securing strap 120 having a first end 121 affixed to the lightweight foam padding 106, such as by stitching 122, and a second end 123 which is introduced through the canister handle and removably attached to the other side of the lightweight foam padding 106, such as by hook and loop fasteners as shown in FIG. 3 and FIG. 4. However, it is to be understood that any mechanism which can secure the canister within the pouch at the requisite ergonomic position is contemplated to be within the scope of the present subject matter. Suitable canister securing mechanisms include, but are not limited to, hook-and-loop fasteners, snap fit fasteners, zipper components, bungee or shock cord straps, magnetic clasps, buckles, high compression composite materials (rubberized fabrics, synthetic elastomers, Lycra™, spandex, nylon, and the like). The securing mechanism should retain the deterrent spray canister within the pouch and provide adjustability and customization.

In an alternate embodiment, the bear spray canister carrying and deployment device does not include the lightweight foam padding component 106 and the securing mechanism is attached directly to the canister pouch itself.

The webbing strap of the armband sleeve can be composed of any lightweight, sturdy, and durable material, particularly a material that resists degradation from the sun and oils, such as body oils, and is water-resistant/water proof and heat-resistant. Preferably, the webbing strap is composed of a fabric material having flexible and/or elastic properties. Suitable materials for the retaining pouch include, but are not limited to, synthetic elastomers, elastomeric blends, nylon, nylon blends, ripstop nylon, ballistic nylon, polyester, polyester blends, leather, synthetic leather (pleather), spandex, Lycra™, polyethylene blends, neoprene, and elastomeric mesh fabrics. In a preferred embodiment, both the webbing strap and the retaining pouch are composed of neoprene. In another preferred embodiment, the pouch is composed of neoprene and the webbing strap is composed of ripstop nylon. However, as will be obvious to those skilled in the art, any type of lightweight, sturdy, and durable material is suitable for use as the fabric material for the webbing strap.

Certain desirable characteristics of the armband sleeve material are comfortability and adjustability such that the armband sleeve will conform with the user's forearm, providing a highly stable and molded fit around the forearm. The armband sleeve should conform precisely to the shape of the user's forearm, offering a tailored, snug fit that prevents any shifting or sliding during dynamic movements. The armband sleeve's ergonomic design ensures that it integrates seamlessly with the user's natural range of motion, enabling an instinctive response during a surprise attack without removal of the canister from the retaining pouch. In an alternate embodiment, the armband sleeve further comprises a rear-facing fabric material capable of reducing sweat accumulation during extended use. Suitable rear-facing fabric materials include, for example, moisture-wicking fabrics, breathable fabrics, and combinations thereof.

The fastening mechanism is designed to be easily adjustable and to secure the webbing strap of the armband sleeve in place without compromising the comfort and accessibility of the deterrent spray. Suitable fastening mechanisms include, but are not limited to, hook and loop fasteners, snap fasteners, zippers, magnetic clasps, buckles, and any other fastening mechanisms that allow adjustability and customization as will be obvious to those skilled in the art. These fastening mechanisms ensure a snug fit and maintain the strap's stability during rigorous activity, such as hiking, running, and biking, preventing the device from shifting or otherwise becoming loose. The fastening mechanism is not limited to a single specific type of system but it is contemplated that any combination of fastening and securing attachment mechanisms are within the scope of the present subject matter. The fastening mechanism should be engineered to provide reliable retention across various activity levels while offering the user comfort and ease of adjustability. The adjustability of the armband sleeve is designed to accommodate a range of forearm sizes.

Referring to the Figures, in a preferred embodiment, the fastening mechanism to detachably fasten the armband sleeve around the forearm of a user comprises hook and loop fasteners. The front surface 105 of the carrying sleeve is provided with a hook-type fastener panel 112 at the distal end 111 and the front surface 105 of the carrying sleeve and pouch also is provided with a complementary loop-type fastener panel 104. To wear the carrying armband sleeve, the user places his or her arm against the rear surface 107 of the carrying armband sleeve and the distal end 111 having the hook-type fastener panel 112 is wrapped over the arm and the distal end is folded back over the arm such that the hook-type fastener panel 112 contacts the loop-type fastener panel 104, and the armband sleeve is detachably fastened to the arm. In a preferred embodiment, the distal end 111 having the hook-type fastener panel 112 then is pulled through the slotted opening 102, the distal end is folded back over the arm such that the hook-type fastener panel 112 contacts the loop-type fastener panel 104, and the sleeve is detachably fastened to the arm. The angle can be adjusted as necessary for the user's arm is ergonomically aligned with the deterrent spray canister.

Figure 5:
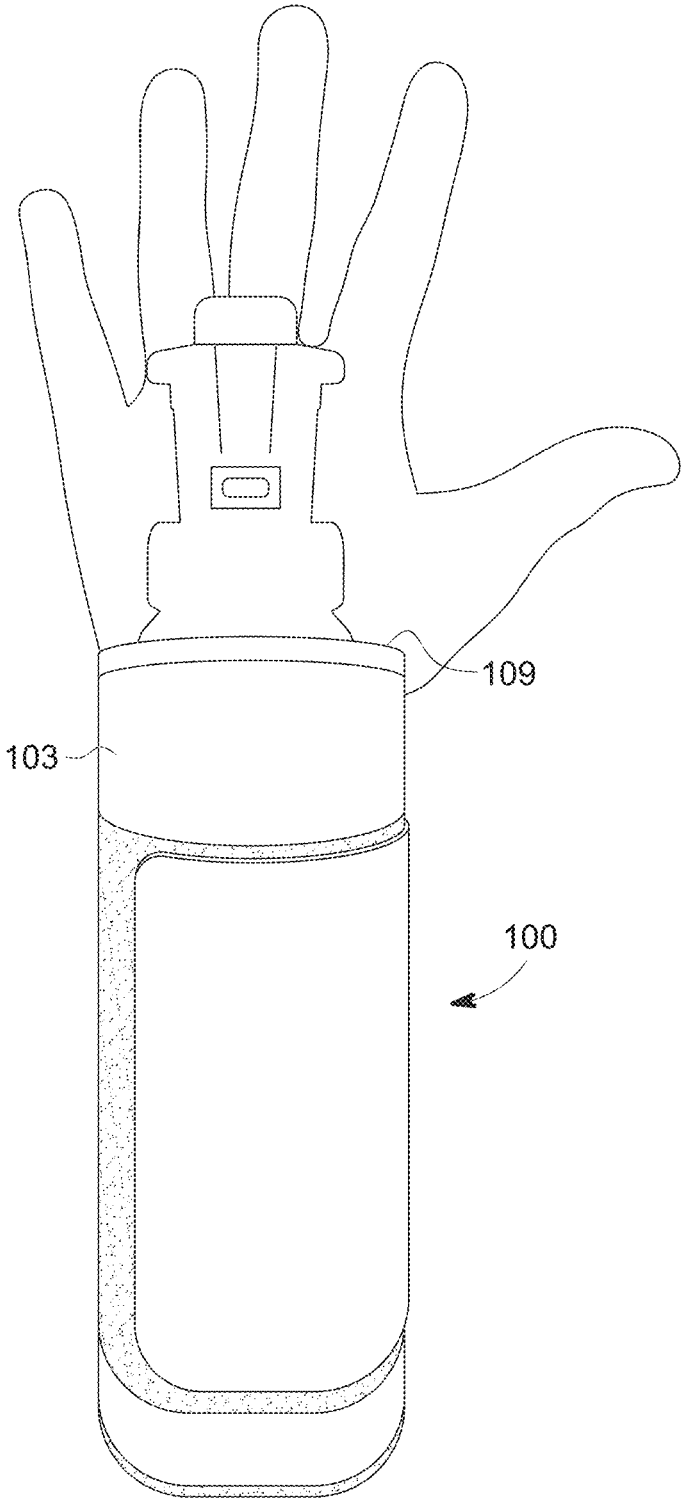
FIG. 5 is a front side perspective view of the bear spray canister carrying and deployment device of the present subject matter as worn on the forearm of a user, illustrating the safety clip and actuator positioned at the user's fingertips.

In a preferred embodiment, the location of the deterrent spray on the wrist and forearm of the user enhances deployment speed when the user encounters a predator, particularly a charging predator. As shown in FIG. 4 and FIG. 5, the forearm-mounted design of the carrying armband sleeve and the ergonomic placement of the deterrent spray aligns the deterrent spray perfectly with the user's body, making the actuator easily accessible such that the user can use his or her index and middle fingers in one fluid, instinctive motion. With this ergonomic design, the user is afforded optimal positioning for rapid access and immediate deployment of the spray with speed and accuracy and without having to remove the canister from the retaining pouch. In this manner, the canister carrying and deployment device of the present subject matter ensures safety during a high-stakes situation where every second counts.

The angled spacing and positioning contour between the canister-retaining pouch and the armband sleeve ensures that the bear spray canister is secured within the retaining pouch and sits at a comfortable angle on the forearm, facilitating ease of access by the index and middle fingers without obstructing the user's movement. This ergonomic angle enhances both comfort and accessibility, particularly when using the bear spray canister carrying and deployment device during an emergency situation. In addition, the ergonomic design and positioning of the canister within the retaining pouch provides added control and recoil support from the discharge pressure of the bear spray canister.

Figure 6:
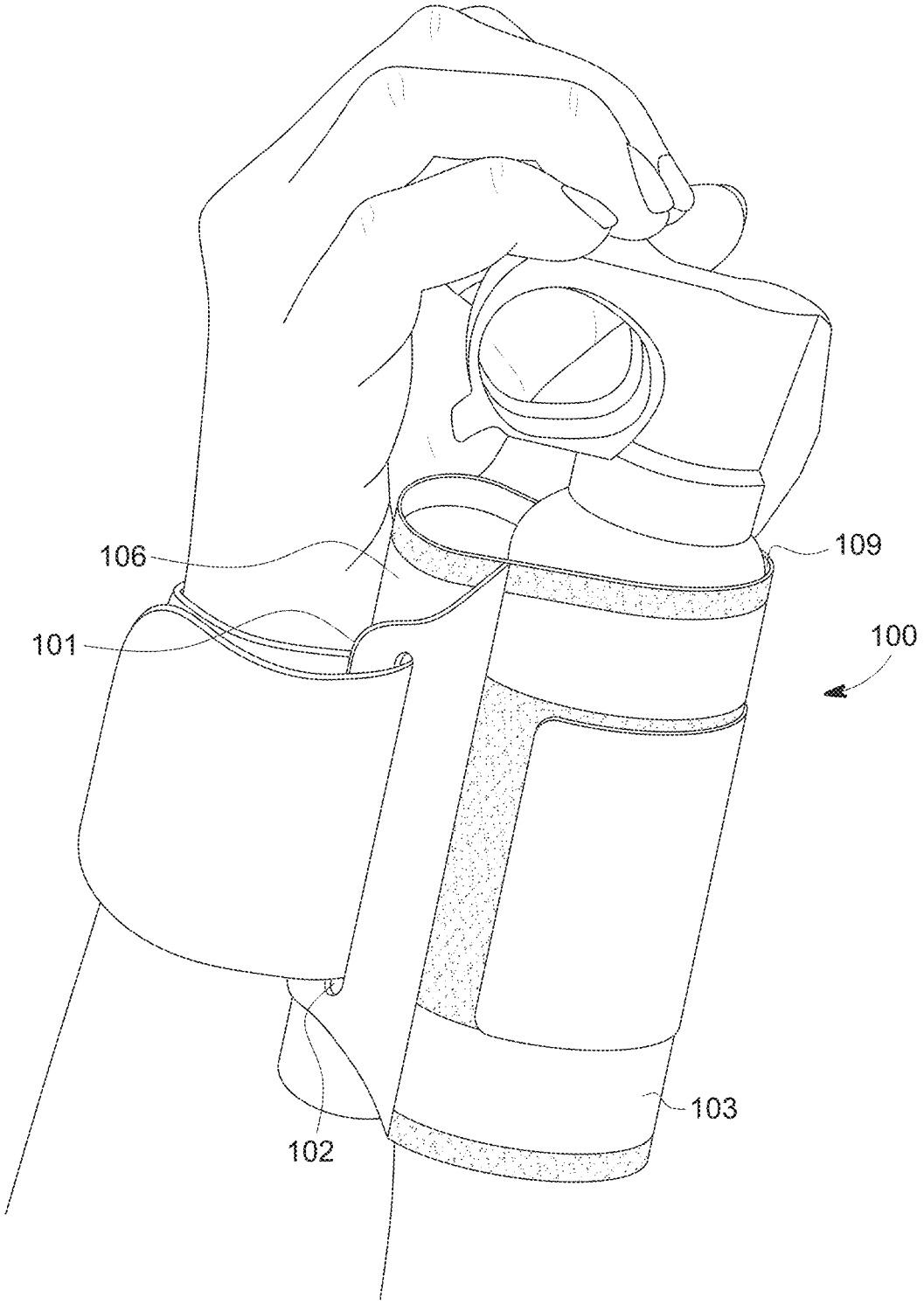
FIG. 6 is a side perspective view of the bear spray canister carrying and deployment device of the present subject matter in the form of an armband worn on the forearm of the user with a bear spray canister secured within the retaining pouch, the canister's safety clip ready to be released and the actuator now positioned at the user's fingertips.

In operation, a user will wrap and secure the armband sleeve 100 around the user's forearm which allows for controlled and easy insertion of the bear spray canister into retaining pouch 103. Once the canister is snugly held within the retaining pouch, the securing mechanism 120 may be tightly wrapped around the neck or body of the canister or the securing mechanism may be engaged through the loop of the handle of the canister, ensuring that the securing mechanism rests flush below the actuator and nozzle area and that it remains securely in place without restricting the actuator or nozzle, which is critical for immediate deployment. The securing mechanism effectively holds the canister within the retaining pouch to ensure that the canister does not shift or dislodge within the pouch. This secure, stable retention maintains the canister in a fixed position, eliminating any risk of unintended movement or loss, even during vigorous activity such as hiking, running, or biking. In a high stress situation, a user will simply pull off the safety clip of the canister as shown in FIG. 6, engage the actuator and deploy the deterrent spray. The user does not have to remove the bear spray canister from the retaining pouch. Rather, it is available for immediate rapid deployment.

Figure 7:
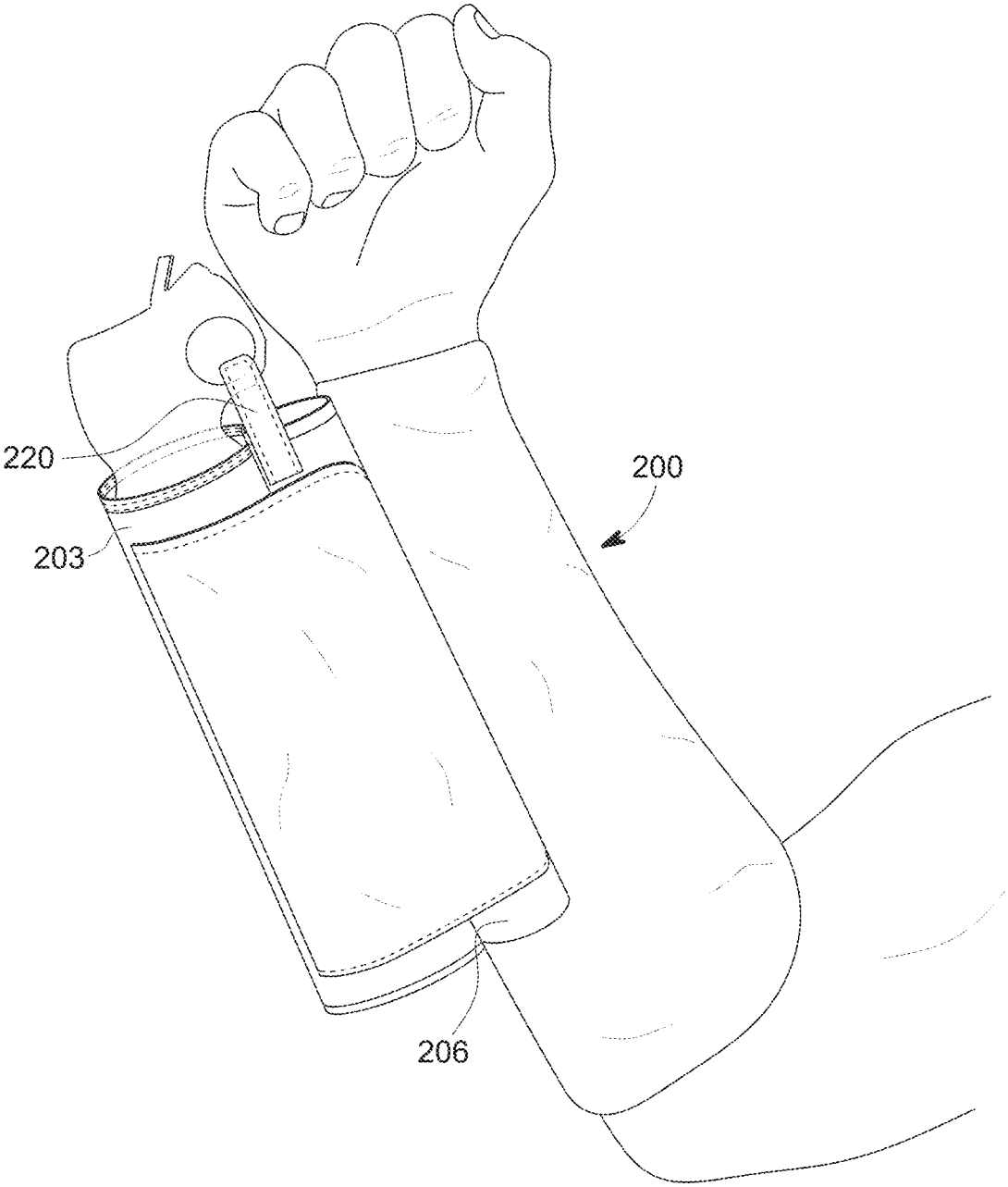
FIG. 7 is a side perspective view of an alternate embodiment of the bear spray canister carrying and deployment device of the present subject matter in the form of a compression sleeve adapted to be worn on the forearm of the user with a bear spray canister secured within a retaining pouch.

FIG. 7 depicts an alternate embodiment of the bear spray carrying and deployment device of the present subject matter. In this embodiment, the carrying and deployment device is in the form of a compression sleeve 200 comprising a retaining pouch 203 affixed to the sleeve, such as by stitching, adhesion, or a combination of both. The compression sleeve 200 is composed of a material that is sufficiently elastic to conform and tightly engage the user's forearm and is integrated seamlessly with the user's natural range of motion. Materials suitable for use as the compression armband sleeve 200 include synthetic elastomers, elastomeric blends, nylon blends, polyethylene blends, spandex, Lycra™, neoprene, neoprene blends, and elastomeric mesh fabrics. Materials suitable for use as the retaining pouch 203 include, but are not limited to, synthetic elastomers, elastomeric blends, nylon blends, neoprene, neoprene blends, and elastomeric mesh fabrics. In a preferred embodiment, the retaining pouch is composed of neoprene or a neoprene blend.

The compression sleeve 200 further comprises a securing mechanism 220 to snugly and firmly hold the canister within the retaining pouch either by wrapping tightly around the neck or body of the canister or by introduction through the loop of the canister, ensuring that it does not shift or dislodge within the pouch. The securing mechanism 220 may be of the same material and design as the securing mechanism 120. The compression sleeve 200 may further comprise a lightweight foam padding 206, corresponding to the lightweight foam padding material 106, fully encapsulated in the same material which is used as the compression armband sleeve and the retaining pouch and disposed between the retaining pouch and the compression armband sleeve. In a preferred embodiment, the lightweight foam padding material 206 is an EVA foam layer fully encapsulated by an outer neoprene cover layer and both the carrying armband sleeve 200 and the retaining pouch 203 are composed of neoprene. The neoprene-covered EVA foam layer is securely affixed to the perimeter of the retaining pouch using reinforced seam binding as well as reinforced seam binding on the compression sleeve material. As described above with reference to FIGS. 1 to 5, the retaining pouch affixed to the compression sleeve, must be designed to securely hold any bear spray canister regardless of size.

The compression sleeve further may comprise a rear-facing fabric material capable of reducing sweat accumulation during extended use. Suitable rear-facing fabric materials are moisture-wicking fabrics, breathable fabrics, and combinations thereof.

The bear spray canister carrying and deployment device of the present subject matter enables a user to carry a bear spray canister comfortably about the user's forearm at a particular ergonomic spacing and positioning, placing the canister's actuator near the user's fingers for rapid deployment and solves the problem of carrying a high-capacity, bear spray canister without the need to remove the canister to deploy the bear spray. This solution enables the user to deploy the bear spray immediately when a user confronts a charging bear, mountain lion or similar wild animal. The device of the present subject matter is a significant improvement over prior art devices which require a user to remove a canister from a holding pouch or holster, remove the safety clip, aim the spray at the charging wild animal, and deploy the spray. The amount of time saved by having the bear spray canister literally at the user's fingertips is invaluable and cannot be overstated. In addition, the ergonomic design and positioning of the canister within the retaining pouch provides added control and recoil support from the discharge pressure of the bear spray canister.

The bear spray canister carrying and deployment device of the present subject matter further may comprise a secondary storage compartment of sufficient size to hold one or more small items such as an ID card, a key, and/or an emergency whistle, and similarly sized items. The front surface of the armband sleeve or compression sleeve may further comprise a designated area for the customizable application of an ID label, particularly useful for wilderness management personnel. And, the front surface of the armband sleeve or compression sleeve may be provided with a material to enhance user safety in low-light conditions. Suitable materials include reflective materials and high-visibility coloration materials.

While several illustrative embodiments of the invention have been shown and described, numerous variations and alternative embodiments will occur to those skilled in the art. Such variations and alternative embodiments are contemplated and can be made without departing from the scope of the invention as defined in the appended claims.

The foregoing detailed description of exemplary and preferred embodiments is presented for purposes of illustration and disclosure in accordance with the requirements of the law. It is not intended to be exhaustive nor to limit the invention to the precise form(s) described, but only to enable others skilled in the art to understand how the invention may be suited for a particular use or implementation. The possibility of modifications and variations will be apparent to practitioners skilled in the art. No limitation is intended by the description of exemplary embodiments which may have included tolerances, feature dimensions, specific operating conditions, engineering specifications, or the like, and which may vary between implementations or with changes to the state of the art, and no limitation should be implied therefrom.

Applicant has made this disclosure with respect to the current state of the art, but also contemplates advancements and that adaptations in the future may take into consideration of those advancements, namely in accordance with the then current state of the art. It is intended that the scope of the invention be defined by the Claims as written and equivalents as applicable. Reference to a claim element in the singular is not intended to mean "one and only one" unless explicitly so stated. Moreover, no element, component, method, or process step in this disclosure is intended to be dedicated to the public regardless of whether the element, under the provisions of 35 U.S.C. § 112, sixth paragraph, unless the element is expressly recited using the phrase "means for . . . " and no method or process step herein is to be construed under those provisions unless the step, or steps, are expressly recited using the phrase "step(s) for . . . ".

The invention claimed is:

1. A bear spray canister carrying and deployment device configured to be secured around a user's forearm comprising a webbing material having a proximal end, a bear spray canister retaining pouch having an elongated body affixed near said proximal end, a front surface, a rear surface, and a distal end, said proximal end and said distal end being detachably fastened to form an adjustable ergonomic armband sleeve adapted to be worn on a user's forearm such that said elongated body of said retaining pouch is parallel to the user's forearm, wherein a bear spray canister having a spray nozzle and actuator is disposed within said retaining pouch and held in fixed, non-rotating position by a securing mechanism, and oriented such that the spray nozzle and actuator of the bear spray cannister is ergonomically positioned to enable tactile finger alignment with the actuator with the hand of the forearm upon which said adjustable ergonomic armband sleeve is worn, without removal of the bear spray canister from said retaining pouch.

2. The bear spray canister carrying and deployment device in accordance with claim 1 which is configured for use in deterring wild animals, including bears and mountain lions.

3. The bear spray canister carrying and deployment device in accordance with claim 1, wherein ergonomic orientation of the actuator of the bear spray cannister secured within said retaining pouch positions the actuator of the bear spray canister tactilely adjacent to the user's index and middle fingers, thereby enabling the user to deliver an intuitive, reflexive, and immediate response to deploy bear spray contained within a bear spray canister with the user's tactilely adjacent fingers without removing the bear spray canister from said retaining pouch.

4. The bear spray canister carrying and deployment device in accordance with claim 3, wherein the actuator of the bear spray canister secured within said retaining pouch is ergonomically oriented at an angle to ensure that a user's fingers on the hand of the forearm upon which the adjustable ergonomic armband sleeve is worn can quickly and easily engage the actuator.

5. The bear spray canister carrying and deployment device in accordance with claim 4, wherein said securing mechanism is selected from the group consisting of hook and loop fastener straps, snap fit fastener straps, zippered components, shock cord straps, magnetic clasps, buckles, and high compression composite materials.

6. The bear spray canister carrying and deployment device in accordance with claim 5, wherein said securing mechanism is in the form of a hook and loop fastening strap which is introduced through a handle on a bear spray canister.

7. The bear spray canister carrying and deployment device in accordance with claim 6, wherein when said ergonomic armband sleeve is worn on a user's forearm, said retaining pouch and said securing mechanism prevent the bear spray canister secured within said retaining pouch from movement, slippage, or misalignment when a user engages in physical activity.

8. The bear spray canister carrying and deployment device in accordance with claim 1, wherein said proximal end of said webbing material has a slotted opening.

9. The bear spray canister carrying and deployment device in accordance with claim 1, wherein said retaining pouch is affixed to said carrying sleeve by stitching.

10. The bear spray canister carrying and deployment device in accordance with claim 1, wherein said retaining pouch further comprises an interior rubber lining to grip the bear spray canister and prevent movement or rotation of the bear spray canister secured within said retaining pouch.

11. The bear spray canister carrying and deployment device in accordance with claim 1, wherein each of said webbing material and said retaining pouch is composed of a lightweight, sturdy, and durable material, resistant from degradation from sun and oils, is water-resistant and heat resistant.

12. The bear spray canister carrying and deployment device in accordance with claim 11, wherein the webbing material is composed of a fabric material having properties selected from the group consisting of flexible properties, elastic properties, and combinations thereof, and wherein said retaining pouch is configured to conform snugly about a bear spray canister retained therein.

13. The bear spray canister carrying and deployment device in accordance with claim 12, wherein said fabric material is selected from the group consisting of synthetic elastomers, elastomeric blends, nylon, nylon blends, ripstop nylon, ballistic nylon, polyester, polyester blends, leather, synthetic leather, spandex, polyethylene blends, neoprene, and elastomeric mesh fabrics.

14. The bear spray canister carrying and deployment device in accordance with claim 13, wherein each of said adjustable ergonomic armband sleeve and said retaining pouch is composed of neoprene.

15. The bear spray canister carrying and deployment device in accordance with claim 13, wherein said adjustable ergonomic armband sleeve is composed of ripstop nylon and said retaining pouch is composed of neoprene.

16. The bear spray canister carrying and deployment device in accordance with claim 1, wherein said proximal end and said distal end are detachably fastened to one another by hook and loop fasteners.

17. The bear spray canister carrying and deployment device in accordance with claim 1, wherein said adjustable ergonomic armband sleeve further comprises a rear-facing fabric material capable of reducing sweat accumulation during extended use.

18. The bear spray canister carrying and deployment device in accordance with claim 17, wherein said rear-facing fabric material is selected from the group consisting of moisture-wicking fabrics, breathable fabrics, and combinations thereof.

19. The bear spray canister carrying and deployment device in accordance with claim 1, wherein the actuator of the bear spray canister secured within said retaining pouch is ergonomically oriented to enable one-handed deployment with the hand of the forearm upon which said adjustable ergonomic armband sleeve is worn without assistance from the user's opposite hand.

20. The bear spray canister carrying and deployment device in accordance with claim 1, wherein said adjustable ergonomic armband sleeve is configured to accommodate a range of forearm sizes.

21. The bear spray canister carrying and deployment device in accordance with claim 1, wherein said retaining pouch is removably affixed to said webbing material.

22. The bear spray canister carrying and deployment device in accordance with claim 1, further comprising a designated area for the customizable application of an identification label.

23. The bear spray canister carrying and deployment device in accordance with claim 1, further comprising a secondary storage compartment.

24. The bear spray canister carrying and deployment device in accordance with claim 23, wherein said secondary storage compartment is of sufficient size to hold at least one item selected from the group consisting of an ID card, a key, and an emergency whistle.

25. The bear spray canister carrying and deployment device in accordance with claim 1, wherein said adjustable ergonomic armband sleeve further comprises a material to enhance user safety in low-light conditions, said material selected from the group consisting of reflective materials and high-visibility coloration materials.

26. A bear spray canister carrying and deployment device in the form of a compression sleeve to be worn on a user's forearm comprising a bear spray canister retaining pouch having an elongated body affixed to said compression sleeve such that said elongated body of said retaining pouch is parallel to the user's forearm, wherein a bear spray canister having a spray nozzle and actuator is disposed within said retaining pouch and held in a fixed, non-rotating position by a securing mechanism, and oriented such that the spray nozzle and actuator of the bear spray canister is ergonomically positioned to enable tactile finger alignment with the actuator with the hand of the forearm upon which said compression sleeve is worn, without removal of the bear spray canister from said retaining pouch.

27. The bear spray canister carrying and deployment device in accordance with claim 26, wherein the ergonomic orientation of the actuator of the bear spray canister secured within said retaining pouch positions the actuator of the bear spray canister tactilely adjacent to the user's index and middle fingers, thereby enabling the user to deliver an intuitive, reflexive, and immediate response to deploy bear spray contained within the bear spray canister with the user's tactilely adjacent to fingers without removing the bear spray canister from said retaining pouch.

28. The bear spray canister carrying and deployment device in accordance with claim 26, wherein when said compressive sleeve is worn on a user's forearm, said retaining pouch and said securing mechanism prevent a bear spray canister secured within said retaining pouch from movement, slippage, or misalignment when a user engages in physical activity.

29. The bear spray canister carrying and deployment device in accordance with claim 26, wherein said compression sleeve further comprises a rear-facing fabric material capable of reducing sweat accumulation during extended use, said rear-facing fabric selected from the group consisting of moisture-wicking fabrics, breathable fabrics, and combinations thereof.

* * * * *